US011376725B1

(12) United States Patent
Hsieh

(10) Patent No.: US 11,376,725 B1
(45) Date of Patent: Jul. 5, 2022

(54) TOOL HOLDER

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 17/315,647

(22) Filed: May 10, 2021

(51) Int. Cl.
*B25H 3/00* (2006.01)

(52) U.S. Cl.
CPC ..... *B25H 3/003* (2013.01)

(58) Field of Classification Search
CPC ..... B25H 3/003; B25H 3/04; B25H 3/006; B25H 3/028; B25H 3/06; B65B 13/56; A47F 7/0028
USPC ..... 206/376, 372, 377, 378; 211/70.6, 69; 248/314; 81/124.3, 124.4, 177.85
See application file for complete search history.

(56) References Cited

U.S. PATENT DOCUMENTS 5,715,951 A * 2/1998 Dembicks ..... B25B 13/56 206/378
5,926,931 A * 7/1999 Collins ..... B25B 13/48 81/124.3
6,032,797 A * 3/2000 Kao ..... B25H 3/04 206/349
6,581,894 B1 * 6/2003 Tong ..... A47F 5/0006 248/314
6,854,607 B2 * 2/2005 Tong ..... B25H 3/003 206/378
6,991,105 B2 * 1/2006 Winnard ..... B25H 3/003 206/378
8,448,787 B1 * 5/2013 Chang ..... B65D 73/0064 206/378
2002/0130235 A1 * 9/2002 Tong ..... E05B 73/0017 248/291.1
2004/0188366 A1 * 9/2004 Tong ..... B25H 3/003 206/378
2004/0211691 A1 * 10/2004 Winnard ..... B25H 3/003 206/378
2005/0218023 A1 * 10/2005 Winnard ..... B25H 3/003 206/378
2005/0221664 A1 * 10/2005 Winnard ..... B25H 3/003 439/510
2007/0034771 A1 * 2/2007 Liu ..... B65D 73/0064 248/682
2007/0114148 A1 * 5/2007 Wheeler ..... G09F 3/10 206/349

(Continued)

*Primary Examiner* — Anthony D Stashick
*Assistant Examiner* — Prince Pal
(74) *Attorney, Agent, or Firm* — Egbert, McDaniel & Swartz, PLLC

(57) ABSTRACT

A tool holder includes: a base, including a chassis, a boss and a convex shaft formed with an abutment plate. A rotating sleeve, including a seat and a quadrangular sleeve joint, and a groove is formed on the bottom surface of the seat to set on the boss. The hollow chamber in the quadrangular sleeve joint is laterally formed with elastic pieces. An intermediate wall is formed between the hollow chamber and the groove, and the intermediate wall is formed with a perforation. A segmented positioning member, including an engaging part formed on the periphery of the boss, and first and second inserting parts. The first and second inserting parts are formed on the circumferential wall of the groove of the rotating sleeve. An elastic anti-dropping flange is formed on the convex shaft of the base, and the outer diameter must be larger than the diameter of the corresponding perforation.

5 Claims, 9 Drawing Sheets

(56) References Cited

U.S. PATENT DOCUMENTS

| | | | | |
|---|---|---|---|---|
| 2008/0047911 | A1* | 2/2008 | Kao | A47F 5/0838 211/70.6 |
| 2011/0048989 | A1* | 3/2011 | Winnard | B25H 3/06 206/349 |
| 2014/0305824 | A1* | 10/2014 | Hsieh | B25H 3/003 206/378 |
| 2015/0165615 | A1* | 6/2015 | Lee | B25H 3/003 206/349 |
| 2017/0043475 | A1* | 2/2017 | Hsieh | B25H 3/003 |
| 2017/0259408 | A1* | 9/2017 | Zhang | B25B 13/06 |
| 2020/0101590 | A1* | 4/2020 | Winnard | C12N 15/86 |
| 2020/0376635 | A1* | 12/2020 | Raskin | H01B 17/56 |
| 2021/0060761 | A1* | 3/2021 | Chang | B25H 3/003 |
| 2021/0122028 | A1* | 4/2021 | Hernandez, Jr. | B25H 3/06 |
| 2021/0156434 | A1* | 5/2021 | Yu | B25B 13/06 |

* cited by examiner

TOOL HOLDER

CROSS-REFERENCE TO RELATED U.S. APPLICATIONS

Not applicable.

BACKGROUND OF THE INVENTION

1. Field of the Invention

The present invention relates generally to a tool holder, and more particularly to an innovative structure type of a tool holder.

2. Description of Related Art Including Information Disclosed Under 37 CFR 1.97 and 37 CFR 1.98

The present invention discusses a tool holder, especially a tool holder form for placing sleeving tools (e.g. sleeves).

This tool holder comprises a base and a rotatable binder. The common structure type can refer to the disclosure of Taiwan patent certificate No. M591462 "sleeve seat" utility patent case declared on Mar. 1, 2020. The binder disclosed in the known technology has a quadrangular driving part for setting the sleeve. A storage slot in outside diameter larger than the quadrangular driving part is formed in one end of the quadrangular driving part, so as to set the cylinder formed on the base. The storage slot and cylindrical structure are provided with an anti-dropping component and a segmented positioning element, wherein the anti-dropping component prevents the base and binder from being disengaged from each other, the segmented positioning element provides inserting positioning segmented hand feeling at two steering angles when the binder is rotating.

However, there are still some problems in the practical application of said sleeve seat structure type. For example, an anti-dropping component and a segmented positioning element are formed in the same annular region of the storage slot and cylindrical structure, in this type of architecture design, there are multiple inward extended lugs on the circumferential wall of the storage slot, to achieve smooth demolding in the injection molding operation, a complex slider and related link mechanism must be added in the mold, so that the manufacturing cost is increased greatly. Additionally, as the specification of binder corresponds to the sleeve specification, when the sleeve specification is small, the specification of binder must be reduced, but in this condition, the inside diameter of storage slot is too small, said slider for demolding may fail to be implemented due to insufficient space.

Moreover, the anti-dropping component and segmented positioning element of the known sleeve seat are arranged in the same annular region, so that their concave and convex positioning configurations influence each other, the mold fabrication is difficult and the stress intensity is influenced.

BRIEF SUMMARY OF THE INVENTION

The primary objective of the present invention is to provide a tool holder, and the technical problem to be solved is how to develop a novel tool holder structure type with more ideal practicability. The tool holder is used for placing the existing sleeving tool. The sleeving tool forms a quadrangular mouthpiece.

Based on said objective, the technical characteristic of problem solving of the present invention is that the tool holder includes: a base, including a chassis, a boss and a convex shaft. The boss with oppositely reduced outside diameter is formed on said chassis. Said convex shaft with oppositely reduced outside diameter protrudes from said boss. Said convex shaft forms at least one abutment plate extended laterally.

The tool holder includes a rotating sleeve includes a seat and a quadrangular sleeve joint. Said quadrangular sleeve joint is used for setting the quadrangular mouthpiece of said sleeving tool. Said seat has a top surface, a bottom surface and a circumferential wall. Said quadrangular sleeve joint with oppositely reduced outside diameter is formed on the top surface of said seat. A groove is formed on the bottom surface of the seat. Said groove is assembled outside said boss of the base, rotatable under stress. A hollow chamber is formed in the quadrangular sleeve joint. At least one elastic piece is laterally formed in the hollow chamber. An engaging part is formed on the outside of each elastic piece. When said elastic piece is propped by the at least one abutment plate in hard mode, said engaging part localizes the quadrangular mouthpiece to prevent said sleeving tool from dropping out. An intermediate wall is formed between said hollow chamber and said groove. A perforation is formed in the intermediate wall, and the shape of the perforation must allow said convex shaft of said base and the at least one abutment plate to enter said hollow chamber through said groove. A segmented positioning member is provided, including at least one engaging part and a first inserting part and a second inserting part for the at least one engaging part the optionally engage with, where the at least one engaging part is formed on the periphery of said boss of said base. Said first inserting part and said second inserting part are formed on the groove of the rotating sleeve.

The tool holder also includes an anti-dropping flange, laterally expanded and formed at the predetermined height of the convex shaft of said base. Said anti-dropping flange is elastic, and the outside diameter thereof must be larger than the corresponding aperture of said perforation. When said convex shaft passes through said perforation, said anti-dropping flange penetrates into said hollow chamber through said perforation in the state of interference fit, so as to prevent said convex shaft from backward dropping out of said hollow chamber.

In terms of the main effect and advantage of the present invention, the anti-dropping flange is located in the hollow chamber of the quadrangular sleeve joint, whereas the segmented positioning member is located outside the hollow chamber, so that the anti-dropping flange and the segmented positioning member are dispersed to two different annular regions. Therefore, the two positioning configurations will not influence each other, it is easier to design the configuration, the mold unloading is more convenient, and the stress intensity is considered, there is practical progressiveness.

DETAILED DESCRIPTION OF THE INVENTION

Figure 1:
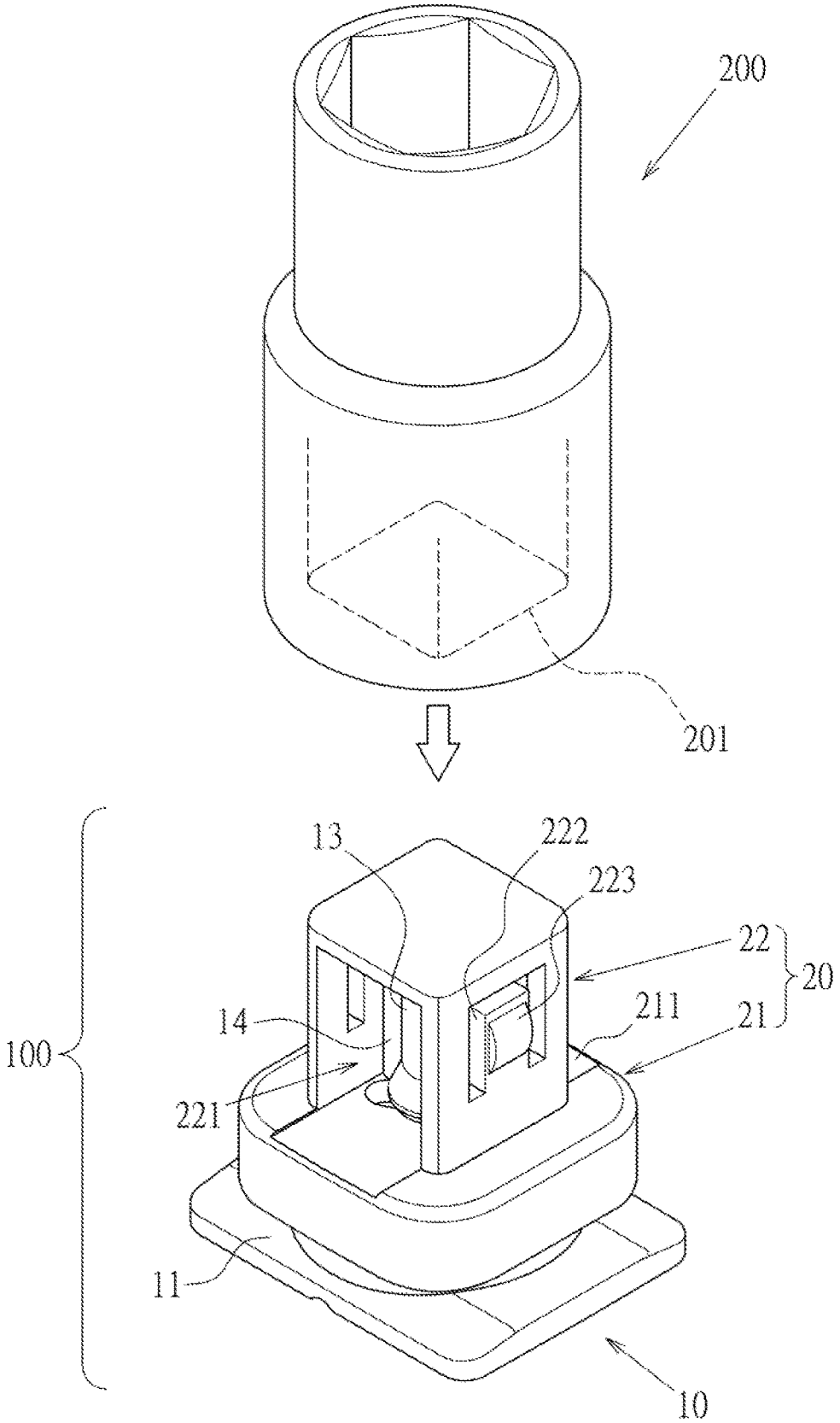
FIG. 1 is a three-dimensional diagram of the tool holder for setting the sleeving tool in the preferred embodiment of the present invention.

FIG. 1 to FIG. 6 show the preferred embodiments of the tool holder of the present invention, but the embodiments are for illustration only, the patent application is not limited to this structure.

The tool holder 100 is provided for placing a sleeving tool 200 (e.g. sleeve), the sleeving tool 200 forms a quadrangular mouthpiece 201. The tool holder 100 comprises a base 10, including a chassis 11, a boss 12 and a convex shaft 13. The boss 12 with shrinking outside diameter is formed on the chassis 11. The convex shaft 13 with shrinking outside diameter protrudes from the boss 12. The convex shaft 13 forms at least one abutment plate 14 extended laterally. A rotating sleeve 20, including a seat 21 and a quadrangular sleeve joint 22. The quadrangular sleeve joint 22 is used for fitting the quadrangular mouthpiece 201 of the sleeving tool 200. The seat 21 has a top surface 211, a bottom surface 212 and a circumferential wall 213. The quadrangular sleeve joint 22 with shrinking outside diameter is formed on the top surface 211 of the seat 21. A groove 214 is formed on the bottom surface 212 of the seat 21. The groove 214 is assembled outside the boss 12 of the base 10, rotatable under stress. A hollow chamber 221 is formed in the quadrangular sleeve joint 22. At least one elastic piece 222 is laterally formed in the hollow chamber 221. An engaging part 223 is formed on the outside of each elastic piece 222. When the elastic piece 222 is propped by at least one abutment plate 14 in hard mode, the engaging part 223 localizes the quadrangular mouthpiece 201 to prevent the sleeving tool 200 from dropping out. An intermediate wall 215 is formed between the hollow chamber 221 and the groove 214. A perforation 23 is formed in the intermediate wall 215. The shape of the perforation 23 must allow the convex shaft 13 of the base 10 and the at least one abutment plate 14 to enter the hollow chamber 221 through the groove 214. A segmented positioning member 30, including at least one engaging part 33 and a first inserting part 31 and a second inserting part 32 for the at least one engaging part 33 to optionally engage with. Wherein the at least one engaging part 33 is formed on the periphery of the boss 12 of the base 10. The first inserting part 31 and the second inserting part 32 are formed in the groove 214 of the rotating sleeve 20. An anti-dropping flange 40, laterally expanded and formed at the predetermined height of the convex shaft 13 of the base 10. The anti-dropping flange 40 is elastic and the outside diameter thereof must be larger than the corresponding aperture of the perforation 23. When the convex shaft 13 passes through the perforation 23, the anti-dropping flange 40 penetrates into the hollow chamber 221 through the perforation 23 in the state of interference fit, so as to prevent the convex shaft 13 from backward dropping out of the hollow chamber 221. Thereby, the anti-dropping flange 40 is located in the hollow chamber 221 of the quadrangular sleeve joint 22, and the segmented positioning member 30 is located outside the hollow chamber 221.

Figure 2:
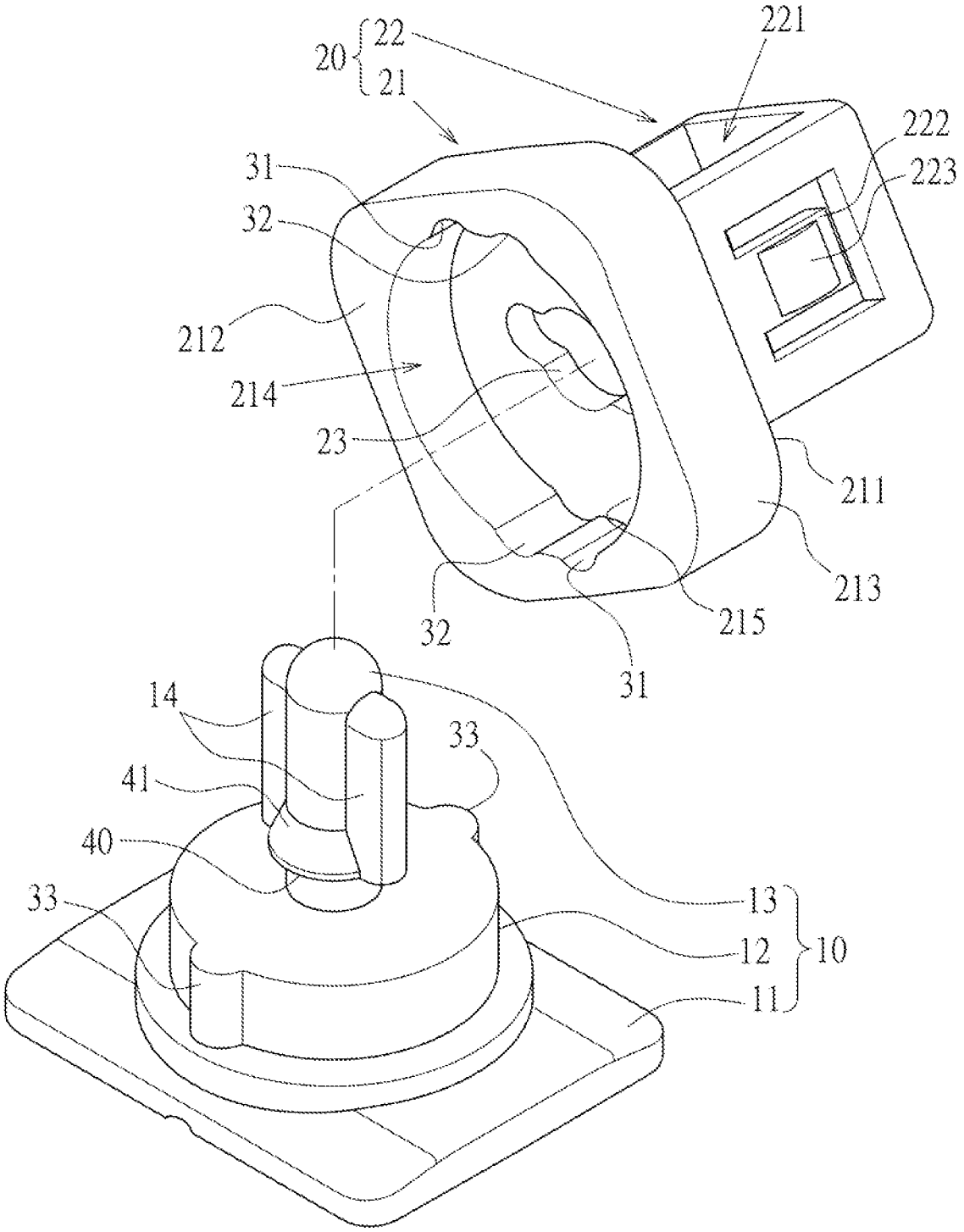
FIG. 2 is a stereogram of the base and rotating sleeve in exploded state in the preferred embodiment of the present invention.
Figure 3:
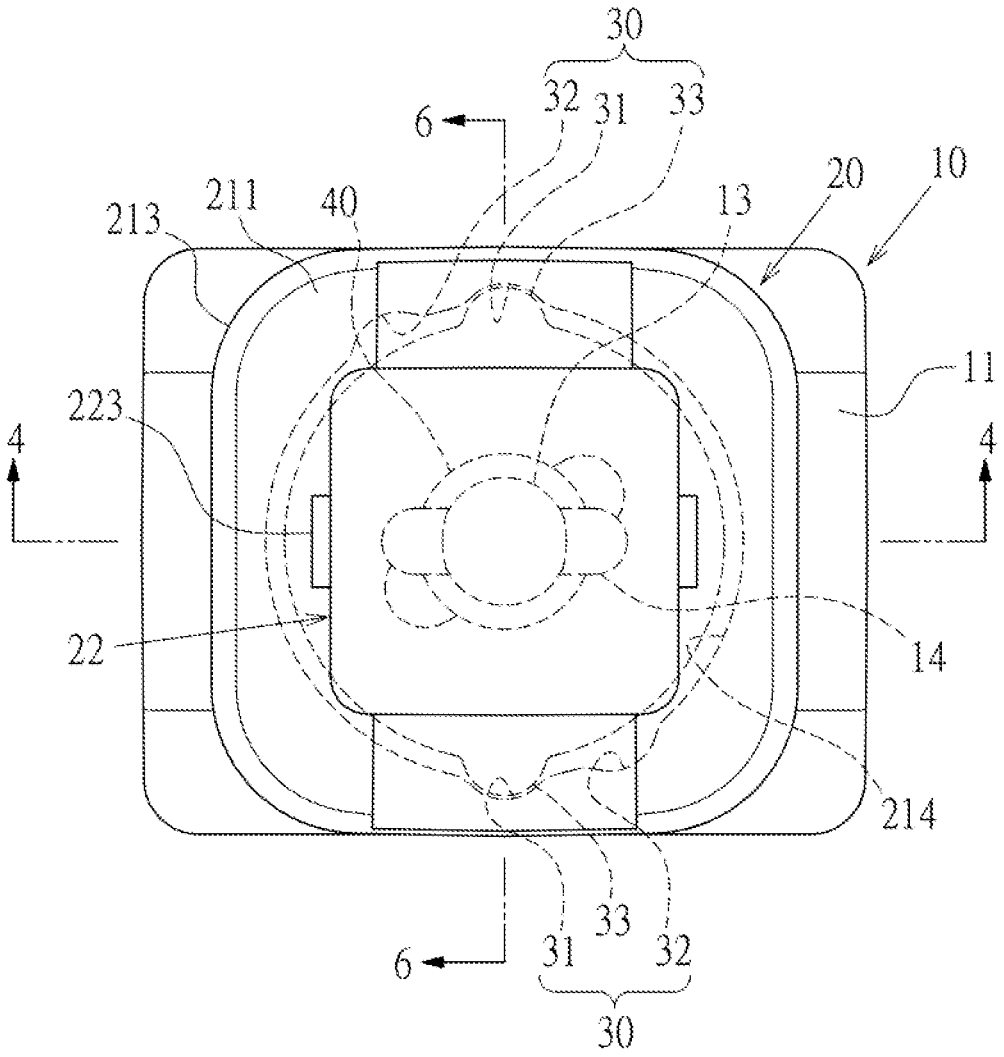
FIG. 3 is a top view of the preferred embodiment of tool holder the present invention.
Figure 4:
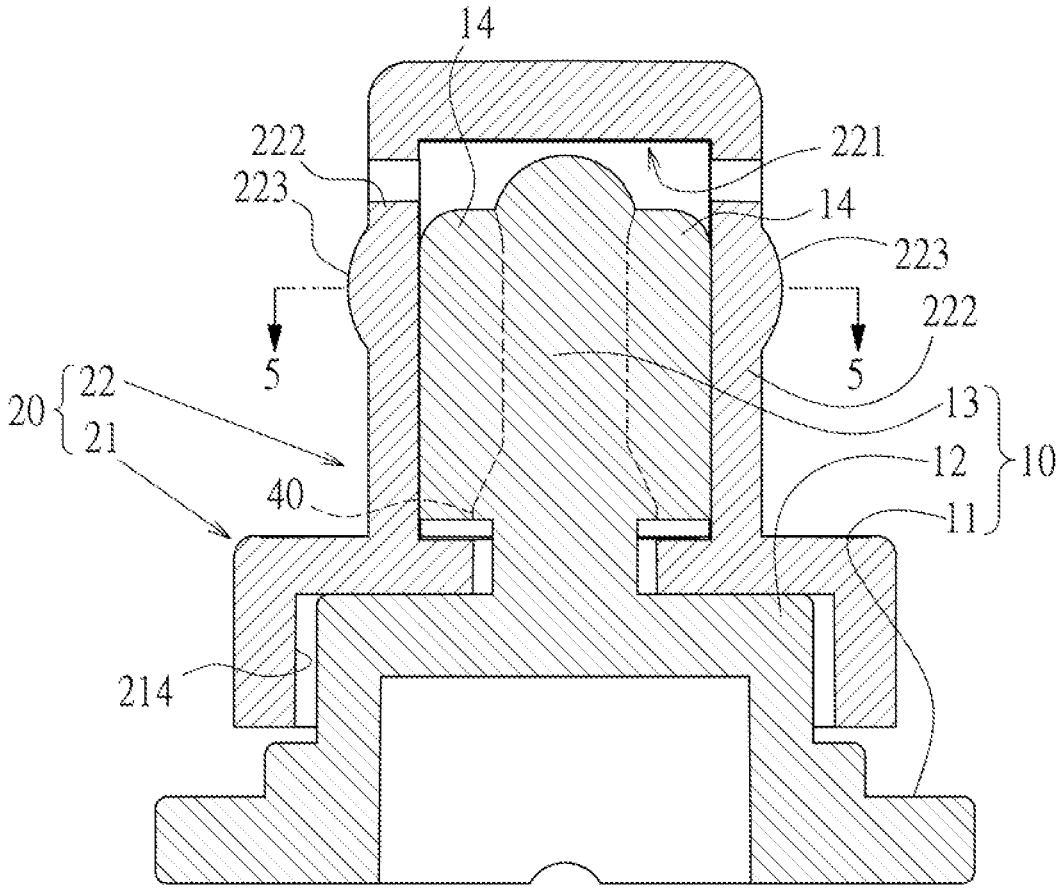
FIG. 4 is the 4-4 sectional view of FIG. 3.
Figure 5:
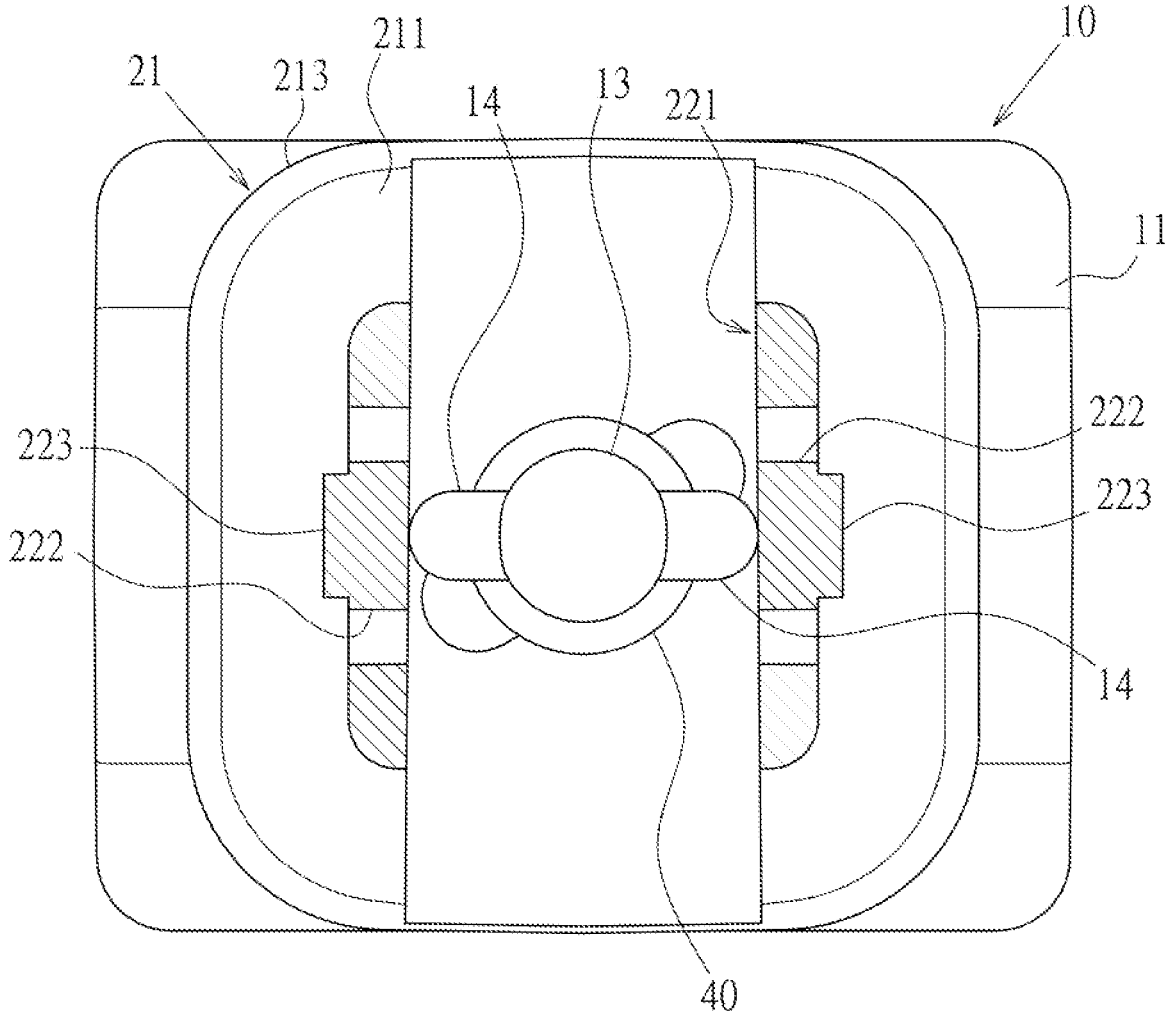
FIG. 5 is the 5-5 sectional view of FIG. 4.
Figure 6:
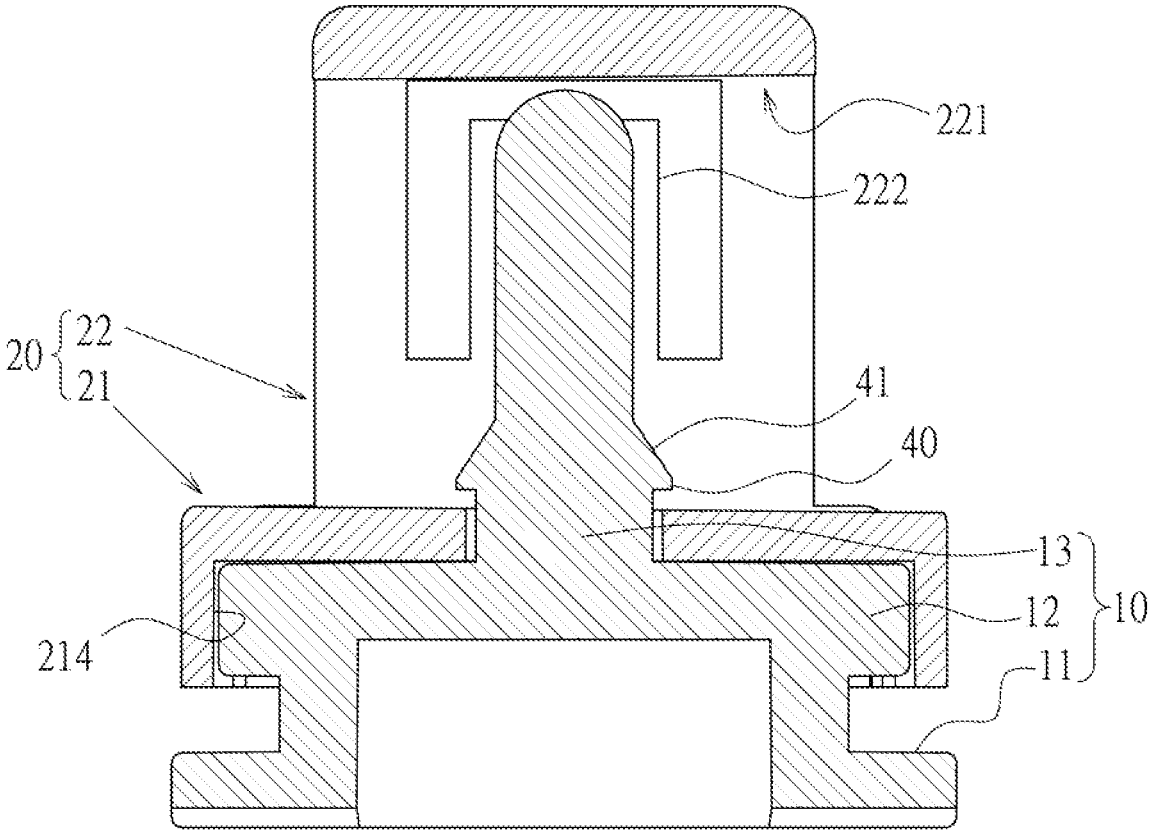
FIG. 6 is the 6-6 sectional view of FIG. 4.

As shown in FIG. 2 and FIG. 3, in this case, the circumferential wall 213 of the seat 21 of the rotating sleeve 20 is rectangular, and each corner is chamfered. The main effect of the implementation pattern disclosed in this case is visual recognition effect. As it is assumed to be circular, quincuncial or gear-shaped, it is difficult for the user to recognize the positioning or release condition of sleeving tool 200 (e.g. sleeve).

As shown in FIG. 2, in this case, the height of the anti-dropping flange 40 is level with the bottom height of the two abutment plates 14.

As shown in FIG. 2 and FIG. 3, in this case, the boss 12 is a circular convex base, the segmented positioning member 30 includes two engaging parts 33 arranged opposite each other at 180° on the periphery of the boss 12 of the base 10. The two engaging parts 33 are laterally projecting cambered bearing ribs. The groove 214 of the rotating sleeve 20 is designed as a slot, two first inserting parts 31 and two second inserting parts 32 are arranged oppositely at 180° on the peripheral slot wall, and the first inserting parts 31 and the second inserting parts 32 are laterally cambered concave margins. Additionally, according to this embodiment, the persons with general knowledge of this technical field can easily understand that concave and convex shapes between the boss 12 and the groove 214 are interchangeable, so the concave and convex shapes of the engaging part 33 and the first inserting part 31 and the second inserting part 32 are interchangeable, that can be implemented in practice.

As shown in FIG. 2, in this case, a bevel guide face 41 is integrally extended from the anti-dropping flange 40 and connected to the convex shaft 13. In terms of the effect of the bevel guide face 41 in this case, the anti-dropping flange 40 can pass through the perforation 23 more smoothly under the guidance of bevel face.

Figure 9:
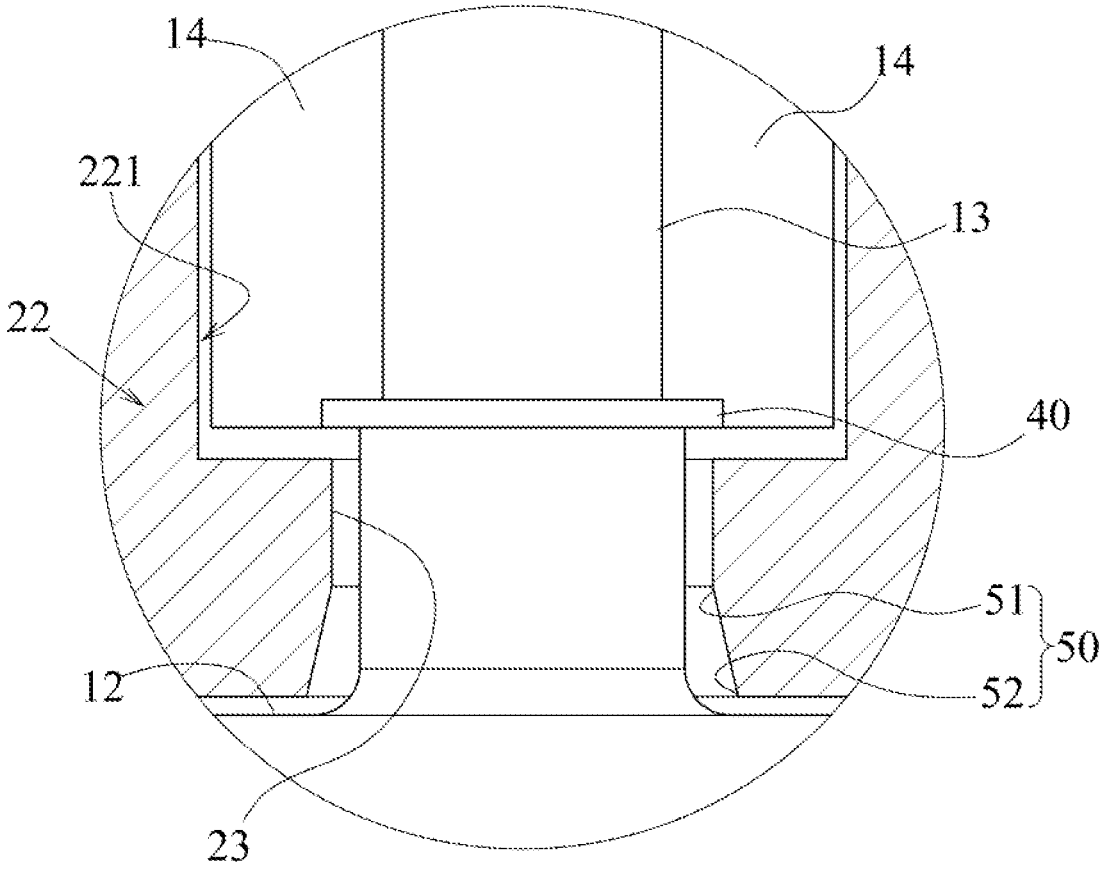
FIG. 9 is a sectional view of an oblique guide lug formed in the perforation of the present invention.

As shown in FIG. 9, in this case, the perforation 23 forms an oblique guide lug 50, the oblique guide lug 50 has a reducing end 51 and an expanding end 52. The oblique guide lug 50 in this case coordinates with the anti-dropping flange 40, the outside diameter of the expanding end 52 is larger than the outside diameter of the anti-dropping flange 40. The outside diameter of the reducing end 51 is smaller than the outside diameter of the anti-dropping flange 40. The effect of the oblique guide lug 50 is as disclosed in previous paragraph, the anti-dropping flange 40 can cross the perforation 23 more smoothly under the guidance of bevel face.

Figure 7:
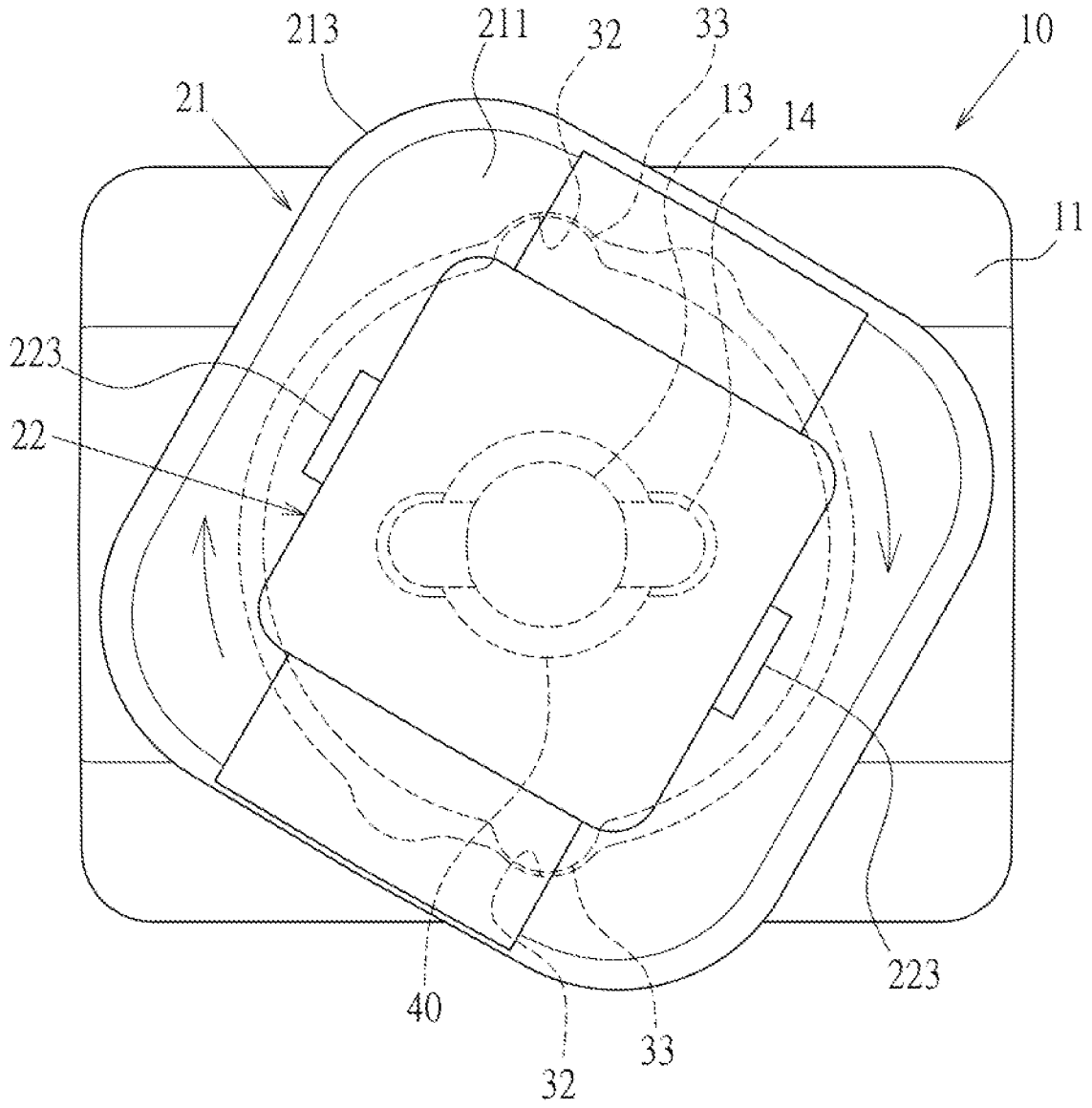
FIG. 7 is a top view of the rotating sleeve rotated to separation angle of the present invention.
Figure 8:
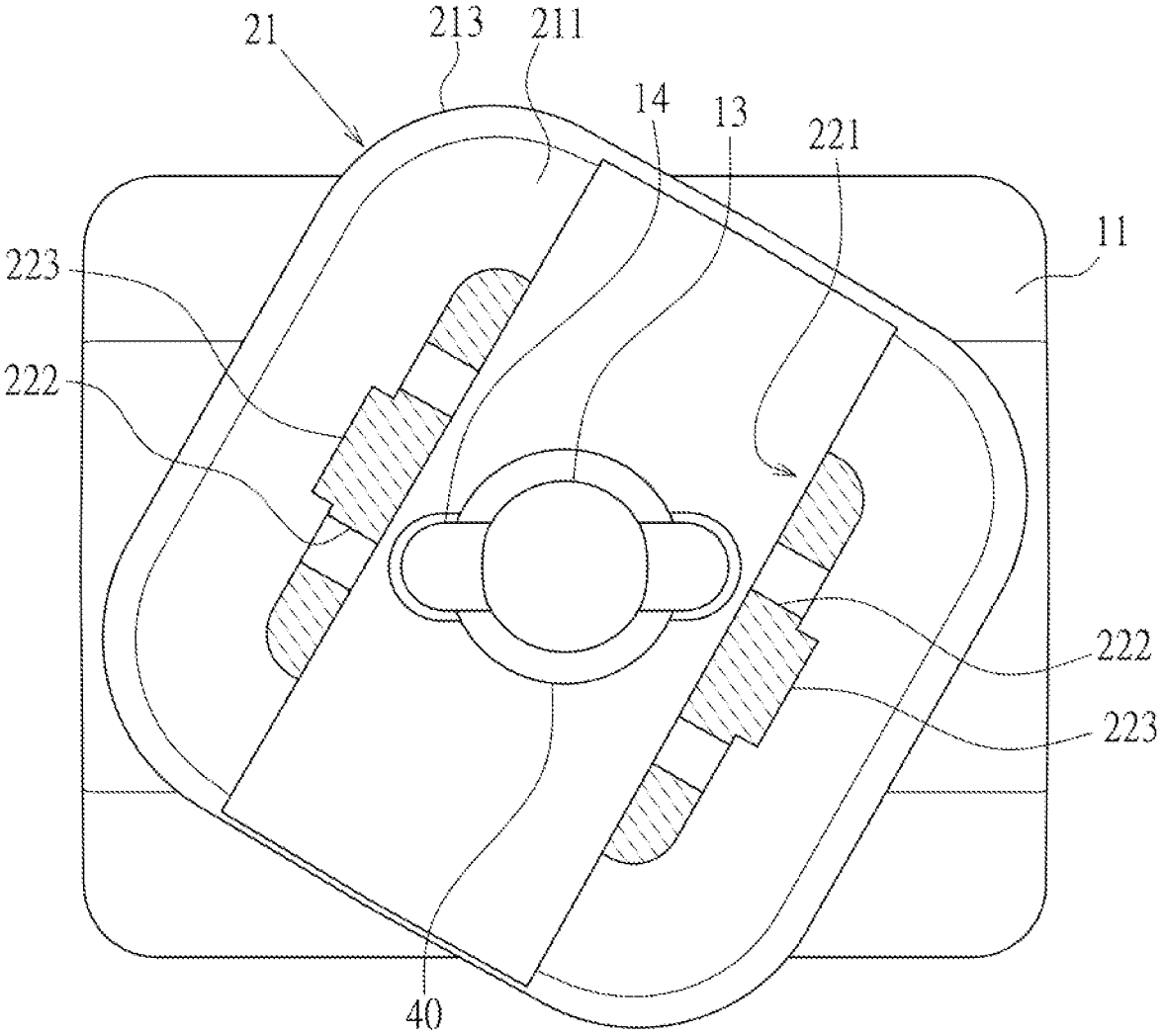
FIG. 8 is a cross-sectional view of partial structure disclosed in FIG. 7.

Based on the aforesaid structure type and technical characteristic, the tool holder 100 disclosed in the present invention is in the preset positioning condition in practice, as shown in FIG. 3 to FIG. 6. In this condition, the rotation angle of rotating sleeve 20 exactly allows the engaging part 33 to engage with the first inserting part 31, so that the elastic piece 222 is propped by the abutment plate 14 in hard mode, and the engaging part 223 localizes the quadrangular mouthpiece 201 (as shown in FIG. 1) to prevent the sleeving tool 200 from dropping out. Afterwards, in the preset release condition as shown in FIG. 7 to FIG. 8, the rotation angle of the seat 21 of rotating sleeve 20 exactly allows the engaging part 33 to engage with the second inserting part 32, so that the elastic piece 222 is not propped by the abutment plate 14, and the engaging part 223 cannot localize the quadrangular mouthpiece 201 (as shown in FIG. 1), the sleeving tool 200 can drop out. The main claimed effect of the present invention is to locate the anti-dropping flange 40 in the hollow chamber 221 of the quadrangular sleeve joint 22, and to locate the segmented positioning member 30 outside the hollow chamber 221, so that the anti-dropping flange 40 and the segmented positioning member 30 are dispersed to two different annular regions. Therefore, the two positioning configurations will not influence each other, it is easier to design the configuration, the mold unloading is more convenient, and the stress intensity is considered.

I claim:

1. A tool holder for placing a sleeving tool in which the sleeving tool has a quadrangular mouthpiece, the tool holder comprising:

a base having a chassis and a boss and a convex shaft, the boss being formed on the chassis, the convex shaft protruding from the boss, the convex shaft having a diameter less than a diameter of the boss, said convex shaft having at least one abutment plate extending laterally therefrom;

a rotating sleeve having a seat and a quadrangular sleeve joint, the quadrangular sleeve joint adapted to set the quadrangular mouthpiece of the sleeving tool, the seat having a top surface and a bottom surface and a wall, the quadrangular sleeve joint being formed on the top surface of the seat, the bottom of the seat having a groove formed thereon, the groove being rotatable and assembled outside of the boss of said base, the quadrangular sleeve joint having a hollow chamber formed therein, at least one elastic piece is laterally formed on a side wall of the quadrangular sleeve joint, at least one elastic piece having an engaging part formed on an exterior thereof, the engaging part adapted to localize the quadrangular mouthpiece so as to prevent the sleeving tool from dropping therefrom when the at least one elastic piece is propped by the at least one abutment plate, wherein an intermediate wall is formed between the hollow chamber and the groove, the intermediate wall having a perforation formed therein, the perforation allowing the convex shaft of said base and the at least one abutment plate to enter the hollow chamber through the groove, said rotating sleeve having a segmental positioning member that has at least one engaging part and a first inserting part and a second inserting part, wherein the at least one engaging part is formed on a periphery of the boss of said base, the first inserting part and the second inserting part being formed on the groove of said rotating sleeve; and an anti-dropping flange that is laterally expanded and formed at a height that is identical to the height of the at least one abutment plate from said base and at a predetermined height relative to a height of the convex shaft, said anti-dropping flange being elastic, said anti-dropping flange having an outside diameter that is greater than a diameter of an aperture of the perforation, said anti-dropping flange penetrating in interference fit relationship into the hollow shaft through the perforation when the convex shaft passes through the perforation so as to prevent the convex shaft from dropping out of the hollow chamber, wherein the wall of said seat is generally rectangular with chamfered corners.

2. The tool holder of claim 1, wherein the at least one abutment plate is two abutment plates, a bottom of said anti-dropping flange being level with a bottom of the two abutment plates.

3. A tool holder for placing a sleeving tool in which the sleeving tool has a quadrangular mouthpiece, the tool holder comprising:

a base having a chassis and a boss and a convex shaft, the boss being formed on the chassis, the convex shaft protruding from the boss, the convex shaft having a diameter less than a diameter of the boss, said convex shaft having at least one abutment plate extending laterally therefrom;

a rotating sleeve having a seat and a quadrangular sleeve joint, the quadrangular sleeve joint adapted to set the quadrangular mouthpiece of the sleeving tool, the seat having a top surface and a bottom surface and a wall, the quadrangular sleeve joint being formed on the top surface of the seat, the bottom of the seat having a groove formed thereon, the groove being rotatable and assembled outside of the boss of said base, the quadrangular sleeve joint having a hollow chamber formed therein, at least one elastic piece is laterally formed on a side wall of the quadrangular sleeve joint, at least one elastic piece having an engaging part formed on an exterior thereof, the engaging part adapted to localize the quadrangular mouthpiece so as to prevent the sleeving tool from dropping therefrom when the at least one elastic piece is propped by the at least one abutment plate, wherein an intermediate wall is formed between the hollow chamber and the groove, the intermediate wall having a perforation formed therein, the perforation allowing the convex shaft of said base and the at least one abutment plate to enter the hollow chamber through the groove, said rotating sleeve having a segmental positioning member that has at least one engaging part and a first inserting part and a second inserting part, wherein the at least one engaging part is formed on a periphery of the boss of said base, the first inserting part and the second inserting part being formed on the groove of said rotating sleeve; and an anti-dropping flange that is laterally expanded and formed at a height that is identical to the height of the at least one abutment plate from said base and at a predetermined height relative to a height of the convex shaft, said anti-dropping flange being elastic, said anti-dropping flange having an outside diameter that is greater than a diameter of an aperture of the perforation, said anti-dropping flange penetrating in interference fit relationship into the hollow shaft through the perforation when the convex shaft passes through the perforation so as to prevent the convex shaft from dropping out of the hollow chamber, wherein the boss has a circular convex base, the at least one engaging part of the segmented positioning member being a pair of engaging parts arranged diametrically opposite to each other on a periphery of the boss of said base, the pair of engaging parts being laterally projecting chamfered bearing ribs, wherein the first inserting part is a pair of first inserting parts, wherein the second insert part is a pair of second inserting parts, the pair of first and second inserting parts each having laterally chamfered concave margins.

4. The tool holder of claim 1, wherein a bevel guide face is upwardly and inwardly extended from said anti-dropping flange and connected to the convex shaft.

5. A tool holder for placing a sleeving tool in which the sleeving tool has a quadrangular mouthpiece, the tool holder comprising:

a base having a chassis and a boss and a convex shaft, the boss being formed on the chassis, the convex shaft protruding from the boss, the convex shaft having a diameter less than a diameter of the boss, said convex shaft having at least one abutment plate extending laterally therefrom;

a rotating sleeve having a seat and a quadrangular sleeve joint, the quadrangular sleeve joint adapted to set the quadrangular mouthpiece of the sleeving tool, the seat having a top surface and a bottom surface and a wall, the quadrangular sleeve joint being formed on the top surface of the seat, the bottom of the seat having a groove formed thereon, the groove being rotatable and assembled outside of the boss of said base, the quadrangular sleeve joint having a hollow chamber formed therein, at least one elastic piece is laterally formed on a side wall of the quadrangular sleeve joint, at least one elastic piece having an engaging part formed on an exterior thereof, the engaging part adapted to localize the quadrangular mouthpiece so as to prevent the sleeving tool from dropping therefrom when the at least one elastic piece is propped by the at least one abutment plate, wherein an intermediate wall is formed between the hollow chamber and the groove, the intermediate wall having a perforation formed therein, the perforation allowing the convex shaft of said base and the at least one abutment plate to enter the hollow chamber through the groove, said rotating sleeve having a segmental positioning member that has at least one engaging part and a first inserting part and a second inserting part, wherein the at least one engaging part is formed on a periphery of the boss of said base, the first inserting part and the second inserting part being formed on the groove of said rotating sleeve; and an anti-dropping flange that is laterally expanded and formed at a height that is identical to the height of the at least one abutment plate from said base and at a predetermined height relative to a height of the convex shaft, said anti-dropping flange being elastic, said anti-dropping flange having an outside diameter that is greater than a diameter of an aperture of the perforation, said anti-dropping flange penetrating in interference fit relationship into the hollow shaft through the perforation when the convex shaft passes through the perforation so as to prevent the convex shaft from dropping out of the hollow chamber, wherein the perforation forms an oblique guide lug, the oblique guide lug having an inwardly slanted surface.

* * * * *